US006091217A

United States Patent [19]

Parsadayan

[11] Patent Number: 6,091,217

[45] Date of Patent: Jul. 18, 2000

[54] SAFETY GATE OPERATOR WHICH PREVENTS ENTRAPMENT, AND METHOD OF ITS OPERATION

[75] Inventor: Walter Parsadayan, Laguna Niguel, Calif.

[73] Assignee: Elite Access Systems, Inc., Lake Forest, Calif.

[21] Appl. No.: 09/015,810

[22] Filed: Jan. 29, 1998

[51] Int. Cl.[7] ..... E05F 15/14

[52] U.S. Cl. ..... 318/285; 318/283; 318/286; 318/469; 49/30

[58] Field of Search ..... 318/264, 265, 318/266, 268, 286, 445, 465, 283, 285, 469; 49/29, 30

[56] References Cited

U.S. PATENT DOCUMENTS

| | | | |
|---|---|---|---|
| 4,357,564 | 11/1982 | Deming et al. | 318/280 |
| 4,401,929 | 8/1983 | Odaka et al. | 318/266 |
| 4,612,485 | 9/1986 | Suska | 318/5 |
| 4,698,622 | 10/1987 | Goto et al. | 318/265 |
| 4,922,168 | 5/1990 | Waggamon | 318/286 |
| 4,980,618 | 12/1990 | Milnes et al. | 318/265 |
| 5,019,758 | 5/1991 | Jones et al. | 318/264 |
| 5,357,183 | 10/1994 | Lin | 318/266 |
| 5,529,157 | 6/1996 | Desrochers | 192/16 |
| 5,557,887 | 9/1996 | Fellows et al. | 318/807 |

*Primary Examiner*—Bentsu Ro

*Attorney, Agent, or Firm*—Oppenheimer Wolff & Donnelly LLP

[57] ABSTRACT

An automatic gate operator includes an electric drive motor coupled by a drive train to a movable gate, and includes provisions for sensing an actual or impending obstruction or blockage of the movement of the gate by a human, object, or animal, for example. In response to such an actual or impending blocking of the gate's movement, the drive motor is shut off and the gate is braked to a stop. Then the gate is reversed to move a short distance away from the actual or impending blockage or obstruction, and is braked again to a stop. Next, the gate is freed from its connection with the drive motor, allowing manual movement of the gate to allow clearance of the actual or impending blockage or obstruction from the path of the gate. This stop-reverse-stop-release sequence of movements for the gate may release any entrapped person or object which may have been contacted by the moving gate. Also, after the gate is released for free movement it can be moved manually. This release of the gate allows an entangled person, object, or animal to free themselves, or to be freed by a bystander, for example. The gate operator also includes a control circuit which senses traffic conditions and responds by incrementing or decrementing a timer which controls a pause interval of the gate in its fully-opened position.

12 Claims, 7 Drawing Sheets

SAFETY GATE OPERATOR WHICH PREVENTS ENTRAPMENT, AND METHOD OF ITS OPERATION

BACKGROUND OF THE INVENTION

1. Field of the Invention

The present invention is in the field of method and apparatus for powered operation of a gate. More particularly, the present invention relates to a power-drive apparatus (i.e., a gate operator) for controllably moving a gate between opened and closed positions, and which has safety features seeking both to prevent entrapment of an object or person in the gate, and also to quickly release such an entrapment should it occur. When an actual or impending blockage or obstruction of the gate occurs, the gate is stopped, backed up a short distance, and stopped again. Then the gate is released from the power drive apparatus allowing it to be moved manually. Thus, a person or animal may free themselves from entanglement in the gate, or may be freed by a bystander, for example. The safety gate operator also has features which reduce or eliminate dithering of the gate near its fully opened position in response to certain high traffic flow conditions.

2. Related Technology

It is conventional to move gates, such as those which control access to a parking lot, to a gated community, to private land, or to a garage, for example, by means of a power-drive unit which moves the gate between fully opened and fully closed positions. In this sense, the term "gate" is used generically, and includes those structures perhaps more commonly referred to as "doors," such as overhead garage doors. Thus, a gate itself may be of any one of several alternative configurations. For example, a gate may slide or roll on wheels to move horizontally along a guide way (a "slide" gate), or may swing as a single piece about a vertical hinge axis (a "swing" gate), or about a horizontal hinge axis (an "overhead" gate), or the gate may roll in sections along a vertically extending track (which track may also include a horizontal section) to open and close (a sectional overhead gate or door).

Ordinarily, the power-drive unit for such gates includes an electric motor with a speed reduction drive train coupled to the gate to effect its movement between the fully opened and fully closed positions. In some cases the speed reduction drive train is implemented mechanically, and in other cases hydraulics are used for this purpose. The limits of movement of the gate which establish the fully opened and fully closed positions are generally set using conventional limit switches associated with the power drive mechanism. Some gate operators simply stall the drive mechanism by driving the gate forcefully against physical limit stops for the movement of the gate. In these cases, a motor current sensor is used to detect the stalled condition and to shut off the drive motor.

Several different safety mechanisms and devices are known and used in various combinations with conventional gate operators, and are intended to facilitate the operation of the gate, to prevent or reduce the impact of the gate against an object that gets in its way, and to also prevent entrapment of an object, animal, or person in the gate. For example, some conventional gate operators employ a light beam and detector (i.e., a photosensor) to sense when an object or person obstructs movement of the gate so as to produce a safety signal. Other gate operators use a "loop detector" which is a buried inductive coil placed in the road way leading to or from a gate opening to produce a safety signal informing the control system of the gate operator when a vehicle has approached or is departing from the gate opening. The control system will include a logic unit effecting a decision algorithm so that a vehicle which is stopped in the gate opening will be known to the gate operator and the gate will not be closed on this vehicle.

Still other gate operators have an "edge sensor" installed on the gate itself to detect when the gate makes contact with an object or person during its movement between its fully opened and fully closed positions, and to consequently produce a safety signal.

Alternatively, a gate operator may employ a motor current sensor to detect approximately when the gate is at its limit positions. When the gate is not proximate to its limit positions, and is thus intermediate of the limit positions in its opening or closing movements, then in the event that an object is encountered and either resists the gate movement sufficiently to cause the drive motor to draw a current above a certain value, or to stop the gate movement by stalling the drive motor entirely (thus, also causing a high motor current), then the gate movement is stopped and then reversed. This causes the gate to disengage from and move away from what ever it has contacted to cause its motion to be resisted or stopped. Some gate operators stop and reverse to their opposite limit of movement. Other gate operators, if they are moving in a closing direction will stop and reverse to their fully opened position. However, if they are moving the gate in an opening direction and such a "high motor current" event takes place, they simply stop the gate and reverse it a short distance only to clear the obstruction. These gate operators do not drive the gate completely to its closed position in such cases. However, in each case the gate remains connected to its drive train. Thus, with conventional gate operators, after an obstruction is encountered and the gate stops, it will not be possible to move the gate manually in order to free an entangled animal or child, for example.

Still other safety devices for gate operators are known and are used in various ways. For example, an ultrasonic transducer can be used to beam sound waves into the area of a gate opening so as to be used as a form of "sonar" to detect objects and people in this gate opening.

In view of the above, it is clear that conventional gate operators have been known for some time which include provisions to detect an object or person in the path of the gate, and to stop the gate in response to this detection. Further, some gate operators have been known which automatically stop and then reverse the direction of gate movement when an object or person is detected or encountered by the gate so as to free any entrapment by the gate which may have occurred. One disadvantage of this method of preventing or freeing an entrapment in the gate is that a person or animal, for example, may have become entangled in the gate, and will then possibly be dragged or injured as the gate is moved in its reversed direction.

Further, experience has shown that children playing or hiding near a gateway present a great risk of entrapment or entanglement. A child or a pet animal, for example, may become entrapped by the gate either when it is opening or closing. In either case, should a child or animal become entrapped and entangled in the gate, a gate operator which merely stops the gate and then reverses its direction to the other limit of gate movement can result in the child or animal possibly being injured by the initial entrapment, and then possibly being dragged and additionally injured as the gate moves in the reverse direction to the limit of its movement. Even those conventional gate operators which stop the gate, and which possibly back the gate away from an obstruction or blockage only a short distance before stopping again, maintain the gate connected to its drive train so that the gate may not be easily moved by an animal, child or bystander, to free the obstruction from the gate.

Another aspect of conventional gate operators which is a disadvantage is their tendency to repeatedly close partially from their fully opened position during periods of continual traffic flow through the gate opening, which traffic flow happens to have an interval between vehicles which is approximately matching the time-out interval of a fully-opened-pause timer of the gate operator. That is, with conventional gate operators, after a particular vehicle has passed through the gate opening, a timer included in the control system of the gate operator times out, and the gate then starts to close. This pause at the fully opened position of the gate may be referred to as a "fully-opened-pause".

If it happens that the interval between vehicles of traffic through the gate is very frequent the safety devices, such as the loop detectors buried in the drive way extending through the gate way, will keep the fully-opened-pause timer in a reset condition so that is does not time out and so that the gate does not begin to close after each vehicle. However, should the frequency of traffic flow through the gateway (i.e., the interval between vehicles) about match the time interval of the fully-opened-pause timer, then the gate will dither.

That is, the gate will start to close, and will stop and re-open again for the next vehicle. Ordinarily, concerns for preventing unauthorized vehicles from passing through the gate opening will dictate that the gate pauses only momentarily at its fully opened position. Consequently, during periods of continual traffic flow with a frequency of passage through the gate opening generally matching the interval of the fully-opened-pause timer, another vehicle may approach the gate while it is closing after its fully-opened-pause, and this vehicle will request passage through the gate opening. In this case, the gate will stop its closing movement and then re-open. When the gate reaches its fully opened position the fully-opened-pause timer will start again (i.e., reset) and will again start the gate closed when it times out. With such a frequency of continual vehicle traffic, however, the gate may again not reach its closed position before it is requested to open again. Under such circumstances, the gate can appear to be in nearly constant motion, stopping only momentarily at its fully opened position before then starting closed, only to stop and reopen in order to allow passage of the next vehicle before pausing and starting closed again.

Understandably, this dithering motion of a gate near its fully opened position is wearing on the gate operator. Further, it actually and undesirably slows down vehicular traffic flow through the gate opening because drivers are usually not willing to pass by a closing gate, and some drivers will stop their vehicle and wait until the gate stops and begins to open again before passing through the gate opening. The result of this delay of traffic actually contributes to the lengthening of the time period during which frequent traffic is passing through the gate opening. Still further, in view of the discussion above about the risk of children and animals being near a gate and possibly being entangled in the gate while it is moving, it is apparent the such dithering by a gate is highly undesirable. That is, a dithering gate spends a much greater time in motion than is actually necessary, and this motion presents a risk to children, animals, and others as described above.

SUMMARY OF THE INVENTION

In view of the above, it is desirable and is an object of this invention to provide a gate operator which includes provision for accepting a safety sensor signal, for example, from a loop detector, from a light beam sensor, or from an edge detector, and which responsively stops movement of the gate to prevent entrapment of a person or object by the moving gate, and which then reverses the gate's movement to release any entrapment which may have occurred. However, and additionally, the gate operator according to the present invention is not to continue movement of the gate in the reversed direction, but is to stop the gate again after moving it in the reverse direction a relatively short distance so as to free but also prevent an entangled person or object from being dragged by the gate as it moves in the reversed direction. Next, the gate operator is to free the gate from its connection with the drive motor and drive train of the gate operator, allowing the gate to be manually moved.

In view of the above, it is seen that any entrapped or entangled person or animal can free themselves, or may be freed by bystanders.

Accordingly, the present invention in one aspect provides a method of power-operating a movable gate member with respect to a gate opening with improved safety so as to prevent prolonged entrapment of an object or person in the gate, and also so as to reduce or substantially prevent injury to the person or object caused by entanglement in the gate, the method employing a stop-reverse-stop movement of the gate, followed by a release of the gate for manual movement; and comprising steps of: providing an electric motor; coupling the electric motor by a speed reduction drive to the movable gate to move the gate between opened and closed positions; providing safety means to sense at least one event selected from the group consisting of the following during operation of the electric motor:

approach of a vehicle to the gate opening, departure of a vehicle from the gate opening, contact of the gate with an object or with a person, and movement of an object or person into the gate opening, the safety means responsively providing a safety signal; providing a brake effective when applied to stop motion of the gate; providing control means for in response to the safety signal stopping operation of the electric motor and applying the brake to stop movement of the gate; and then sequentially operating the electric motor in a reverse direction only momentarily to move the gate in a reverse direction, and then again stopping operation of the electric motor and again applying the brake to stop the gate for a second time; followed by a release of the gate from its driving connection with the electric motor of the gate operator allowing manual movement of the gate.

According to another aspect, the present invention provides a safety gate operator for moving a gate between opened and closed positions, the gate operator comprising: an electric motor and motor controller circuit; a speed reduction power train coupling the electric motor to the gate to move the gate between opened and closed positions; a gate movement sensor providing a signal indicative of gate position; a safety means during operation of the electric motor sensing at least one event selected from the group consisting of:

approach of a vehicle to the gate opening, contact of the gate with an object or with a person, and movement of an object or person into the gate opening, the safety means responsively providing a safety signal; a brake effective when applied to stop movement of the gate; the speed reduction power train including a clutch coupling power from the electric motor to the gate, and when disconnected allowing movement of the gate without back driving of the electric motor while still providing responsive movement of the gate movement sensor; a control system including a memory facility; and the control system including control logic for in response to the safety signal stopping operation of the electric motor, and sequentially applying the brake to stop movement of the gate; the control logic then causing the control system to sequentially operate the electric motor in a reverse direction only momentarily to move the gate in a reverse direction, and then again stopping operation of the electric motor and again applying the brake to stop the gate for a second time; the control system next releasing the gate from driving connection with the electric motor allowing manual movement of the gate.

An important safety advantage of the present invention derives from its sequence of stop-reverse-stop-release for the gate following a safety signal. That is, when an object or person is encountered by the gate, the gate is stopped. However, in case an entrapment has occurred, the gate reverses to free the entrapment. But in case an entanglement in the gate has occurred, the gate is reversed and moved only a few inches, for example, in order to free the obstruction but not so far as to drag and injure further an entangled person or animal, after which the gate is stopped again. Finally, the gate is freed with respect to the power drive unit so that manual movement of the gate can be effected, allowing an entangled object or person to free themselves or to be freed by a bystander.

As can be seen from the above, the present gate operator provides a combination of features and functions which minimized the injury risk from entrapment by the gate, and from entanglement in the gate, as well as allowing subsequent manual movement of the gate so that an entangled person, animal, or object can manually free themselves or be freed from the gate.

Also, in view of the above, it would be an advantage and is an object for this invention to provide a gate operator which automatically adjusts the fully-opened-pause of the gate during intervals of continual traffic flow through the gate opening which has a frequency generally matching an initial time interval for a fully-opened-pause timer.

Accordingly, it is an object for this invention to provide also such a gate operator with a logic function which senses continual traffic flow through the gate opening substantially matching the interval of the fully-opened-pause timer, and which automatically adjusts the interval of the fully-opened-pause for the gate.

An advantage of the gate operator with such an automatic adjustment of the pause interval for the gate at its fully opened position is that the gate will remain at its fully opened position under such traffic conditions, and will not dither part way closed only to re-open for the next vehicle. During periods of less-frequent traffic flow, the gate operator will revert to a shorter fully-opened-pause, so that the concern for preventing unauthorized vehicles from easily passing through the gate opening is observed.

A better understanding of the present invention will be obtained from reading the following description of a single preferred exemplary embodiment of the present invention when taken in conjunction with the appended drawing Figures, in which the same features (or features analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides a fragmentary perspective view of a gate operator embodying the present invention moving a "sliding" gate relative to a gate opening between opened and closed positions;

FIG. 2 is a somewhat schematic perspective view of the gate operator shown in FIG. 1, but with its weather cover illustrated in phantom, and is illustrated from the side opposite to that seen in FIG. 1;

FIG. 3 provides a fragmentary cross sectional view of a portion of the gate operator seen in FIGS. 1 and 21, and is provided at a larger scale than FIG. 2 in order to better illustrate details of construction for the gate operator.

FIG. 4 provides a perspective view, partially in cross section, of a limit switch assembly portion of the gate operator, which limit switch assembly provides electrical signals indicative of gate movement and position;

FIG. 5 is a schematic illustration of an electrical and electronic control circuit portion of the gate operator;

FIG. 5*a* provides a fragmentary schematic illustration of an alternative implementation of a portion of a control circuit as is seen in FIG. 5;

FIGS. 6 and 6*a* provide a logic diagram in the form of a programming flow chart for a control unit of the gate operator seen in preceding drawing Figures; and FIG. 7 provides a logic diagram in the form of programming flow charts for a control unit of the gate operator seen in preceding drawing Figures.

DETAILED DESCRIPTION OF EXEMPLARY PREFERRED EMBODIMENTS OF THE INVENTION

Figure 1:
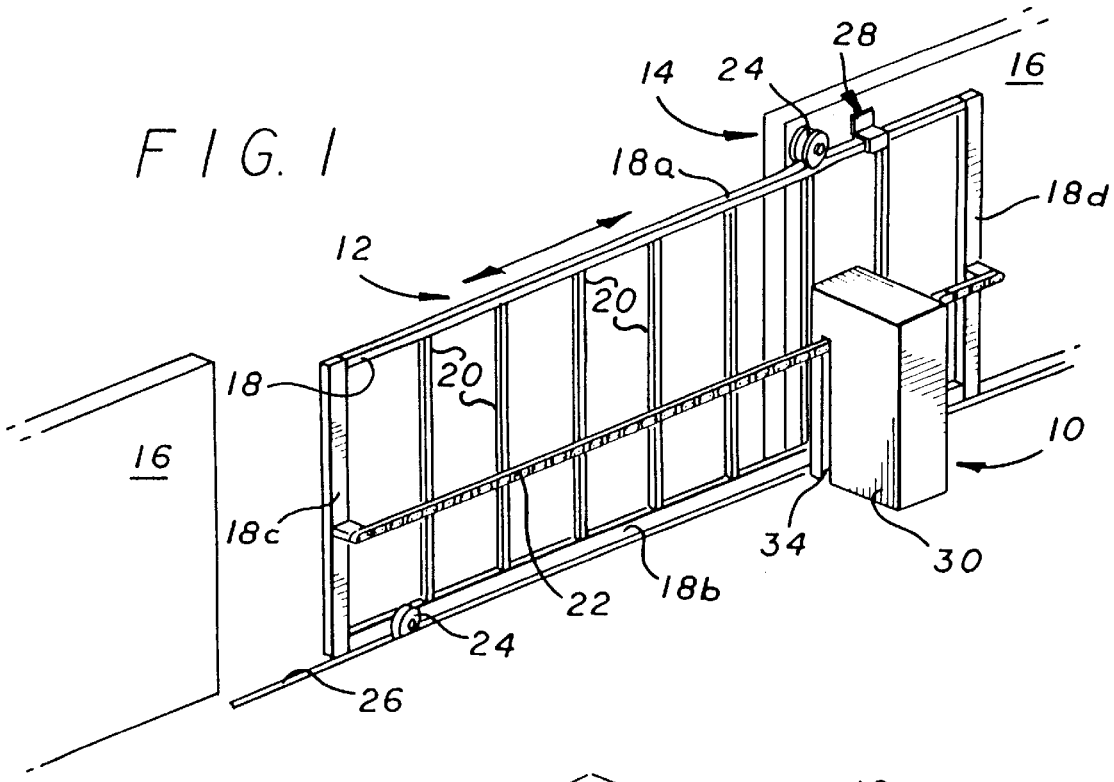

Viewing first FIG. 1, a gate operator 10 is connected to a gate 12 to move the gate between opened and closed positions with respect to a gate opening 14 in a wall or fence 16. In this case, the gate 12 is of "sliding gate" style, although the present invention in other implementations or embodiments can be used with gates of other configurations. That is, for example and without limitation, the gate 12 may alternatively be a swing gate type, or an overhead gate or door, and the present invention may be embodied in a gate operator to move these types of gates, as will be well understood by one ordinarily skilled in the pertinent arts.

More particularly, the gate 12 includes a gate frame 18 having a plurality of vertical pickets or bars 20 extending between upper and lower horizontal portions 18*a* and 18*b* of the frame 18. At its opposite ends, the gate frame 18 includes vertical frame members 18*c* and 18*d*, between which extends an elongate drive chain 22. The gate frame 18 is carried and guided by a plurality of guide wheels and/or rollers 24 (only two of which are seen in FIG. 1), the wheels of which roll along a guide track 26 extending along the ground. As seen in FIG. 1, the guide wheels and rollers may include one or more guide rollers which are mounted to stationary structure, such as the wall 16 to further support and guide the gate 12.

Attached to the wall 16 (or to a post of the fence, for example) additionally may be an upper guide assembly 28, which also assists in guiding the gate 12 in its movements between fully opened and fully closed positions. Those ordinarily skilled in the pertinent arts will known that the upper guide assembly may constrain the upper horizontal member 18*b* of the frame 18 in order to resist forcing of the gate 12 from its guide way. Accordingly, it is seen that the gate 12 is movable horizontally along the guide track 26 between an opened position allowing ingress and egress of vehicles and personnel (for example) via the gate opening 14, and a closed position in which the gate 12 closes the gate opening 16. In FIG. 1, the gate 12 is depicted in a position intermediate of its fully opened and fully closed positions. Also associated with the gate 12 are one or more safety devices, generally indicated with the character "S". These safety devices may include one or more of a buried loop detector "Sa", a light beam obstruction detection "Sb", or an edge contact detector "Sc", which is carried on the portion 18*c* of the gate 12.

Figure 2:
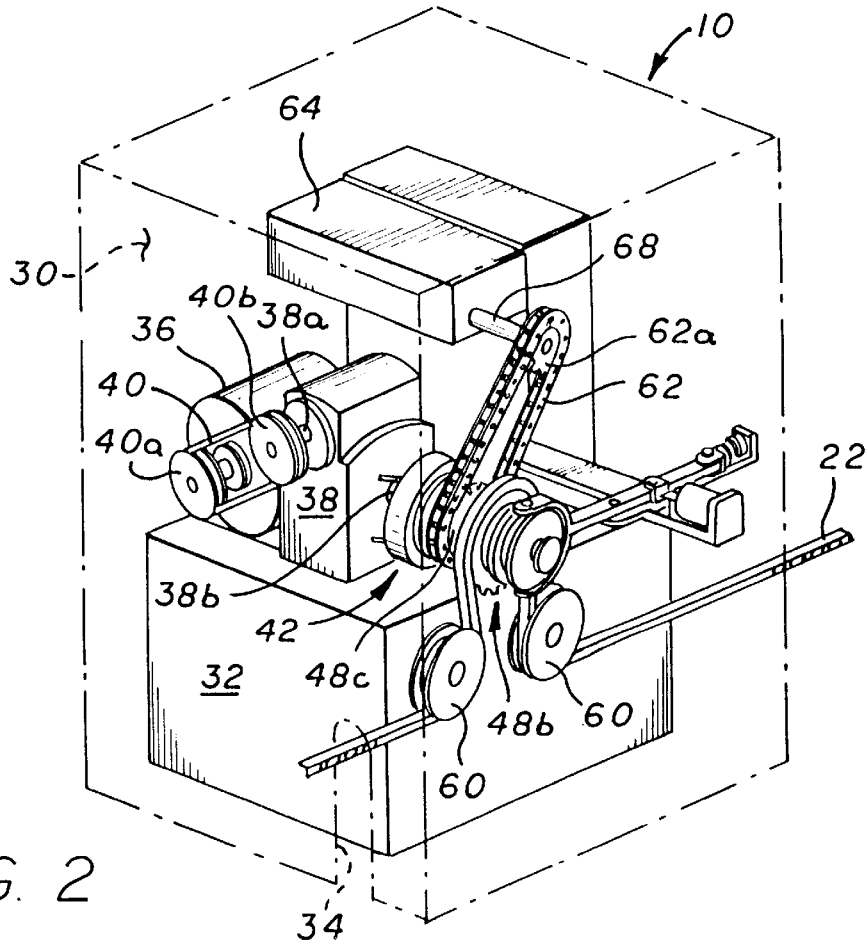

Viewing FIG. 2 in combination with FIG. 1, it is seen that the elongate drive chain 22 extends through a weather-proof cover of the operator 10, and the operator 10 is effective as will be further seen below to drive the chain 22 (and gate 12) from side to side in order to open and close the gate. Viewing FIG. 2 in greater detail, it is seen that the gate operator 10 includes a base 32 over which the cover is fitted, and that this cover defines a pair of openings or slots 34 (only one of which is shown in FIG. 2) allowing the drive chain 22 to pass through this cover. The base 32 carries a reversible electric motor 36 drivingly connected to a gear reduction unit 38 by a drive belt 40 trained over respective pulleys 40*a* and 40*b*. In this case, the gear reduction unit 38 is of worm gear type, has respective input and output shafts 38*a* and 38*b*, and provides a speed reduction ratio of about 30:1, although the invention is not limited to this or any other type of speed reduction.

Advantageously, the worm gear type of gear reduction unit provides a "no-back" drive arrangement for the gate 12. This "no-back" drive arrangement effectively prevents the gate 12 from being forcibly opened from its fully closed position by an unauthorized person. However, other types of drive mechanisms may be used alternatively. For example, a spur-gear type of gear reduction might be used, or one using entirely chains and sprockets, or using entirely belts and pulleys, or a mix of chains and belts might be used in the drive mechanism.

Still viewing FIG. 2, it is seen that a clutch/brake assembly 42 is carried on the output shaft 38*b* of the gear reduction unit 38. Viewing FIG. 3 in combination with FIG. 2, it is seen that the clutch/brake assembly 42 includes an electromagnetic brake unit 44, which has an electromagnet and anchor member 44*a* secured for torque reaction to the base 32. This brake unit 44 also has an armature 44*b* carried on but not itself drivingly connected to shaft 38*b*, as will be further explained. A pair of electrical power connection wires 44*c* extend from the electromagnetic anchor member 44*a* to a control circuit of the operator 10 (as will be further explained). Thus, when the brake 44 is actuated, the armature 44*b* is drawn magnetically into braking engagement with the anchor unit 44*a*, and resists rotation of the armature 44*b*.

Clutch/brake assembly 42 also includes a clutch unit 46, which in this case, is a dog-type clutch assembly (although the invention is not so limited). The dog type clutch assembly includes a sprocket unit 48, which is freely rotational on shaft 38*b*, but which is constrained against axial motion along this shaft. On one side, the sprocket unit 48 carries and is drivingly connected to the armature 44*b*. The driving relationship between sprocket unit 48 and armature 44*b* allows for the axial relative movement of the latter in order to engage in braking relation with anchor unit 44*a*. Ordinarily, when the brake 44 is not energized, the armature 44*b* is carried by sprocket assembly 48, and turns freely in axially spaced but close relation to the anchor unit 44*a*.

The sprocket unit 48 on the other side opposite to clutch unit 46 includes a circular array of clutch dogs, indicated with numeral 48*a*. These clutch dogs are engageable in driving relationship with a similar circular array of clutch dogs 50*a* defined on a clutch sleeve member 50, which is also a part of the clutch unit 46. This clutch sleeve member 50 is drivingly carried on the shaft 38*b*, and is movable along this shaft 38*b* between a first position as seen in FIG. 3 in which the dogs 48*a* engage dogs 50*a*, and a second position spaced from sprocket assembly 48, and in which the clutch dogs 48*a* and 50*a* are not engaged with one another.

Figure 3:
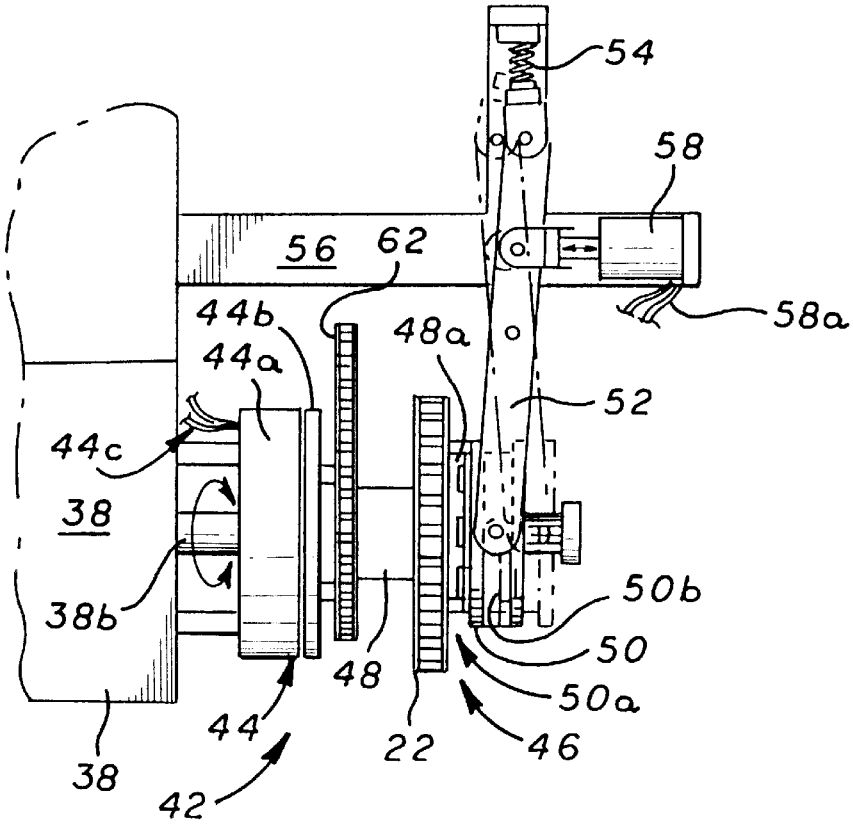

In order to move the clutch sleeve member 50 selectively between its first and second positions, the clutch unit 46 also includes a mechanical bi-stable device, which includes a pivotal shift yoke 52 engaging into a circumferential groove 50*b* of the clutch sleeve 50, and a coil compression spring 54 pivotally biasing the yoke 52 either to the position seen in solid lines in FIG. 3, or to the position seen in dashed lines in this Figure. The yoke 52 and spring 54 are carried by a bracket 56 secured to and extending from the base 30.

An electromagnetic solenoid 58 is carried by the bracket 56, and is effective when energized to move the yoke 52 between its first and second positions, thus also moving the clutch sleeve 50. A pair of electrical power wires 58*a* extend from the solenoid 58 to the control circuit of the gate operator 10, as also will be further explained.

Further considering the sprocket unit 48, it is seen that this unit includes two sprockets 48*b* and 48*c* in axially spaced and drivingly connected relation to one another. The drive chain 22 is trained about the sprocket 48*b*, and is guided about this sprocket 48*b* by a pair of flanged guide wheels 60. Effectively, the sprocket 48*b* is the output member of the gate operator 10, and rotation of this sprocket translates directly to movement of the gate 12 (recognizing that there will inevitably be some lost motion or slack in the mechanical connection effected by drive chain 22). Sprocket unit 48 also includes a sprocket 48*c*, which may utilize a smaller size of chain than the drive chain 22 for the gate 12. A loop of chain 62 is trained about the sprocket 48*c*, and extends to a matching sprocket 62*a* carried by a gate movement measuring unit 64.

Figure 4:
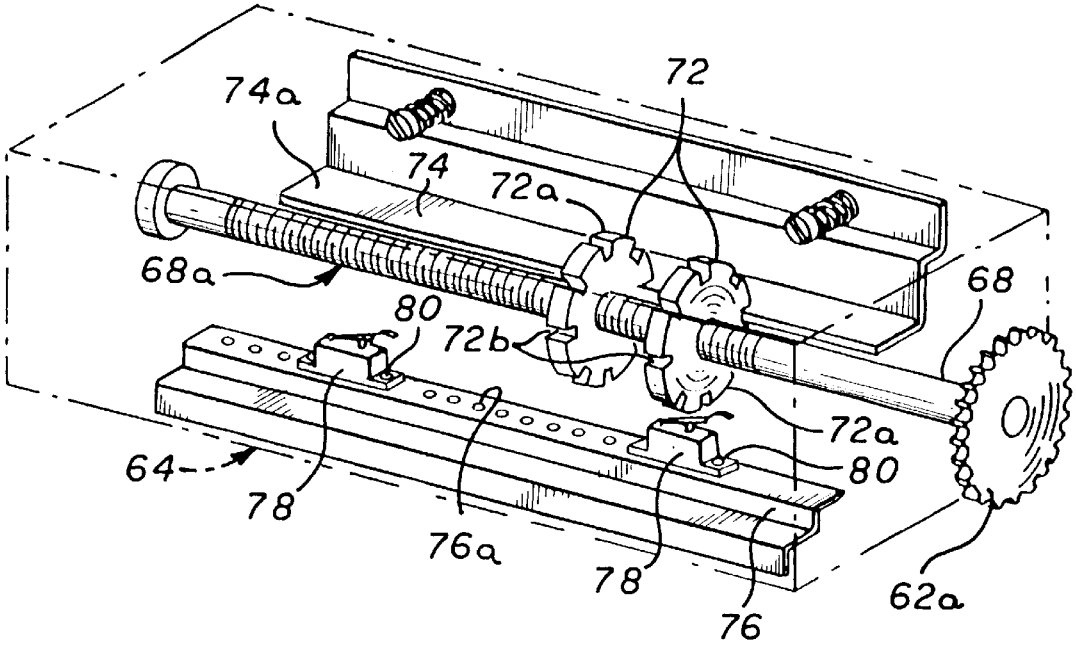

The measuring unit 64 is carried by the base 32 and is associated with the motor 36 via an electronic control circuit unit 66, the structure and functions of which will be further explained below. As is seen in FIGS. 2 and 4, the gate movement measuring unit 64 includes a rotational shaft 68 which is coupled to rotate simultaneously and in proportion to rotation of the drive sprocket 48*c* by connection of chain 62 from sprocket 48*c* engaging with the sprocket 62*a* drivingly carried on the shaft 68. In this case, the driving connection between shaft 38*b* and shaft 68 may provide for an over-driving (i.e., rotational speed increase) relationship between the sprocket 48*b* and shaft 68, although the invention is not limited to this relationship. In other words, and as will be appreciated in view of alternative embodiments disclosed herein, an over-driving relationship, a unity relationship, or an under-driving relationship may be provided between the output member (sprocket 48*b*) of the gate operator and the gate movement measuring unit 64.

Further considering the gate movement measuring unit 64 as it is schematically seen in FIG. 4, the shaft 68 is seen to include an elongate threaded portion 68*a*. Threadably carried upon the threaded portion 68*a* are a pair of limit disks 72, each having a circumferential outer perimeter surface 72*a* defining a circumferentially spaced apart plurality of axial grooves or notches 72*b*. The gate movement measuring unit 64 includes a movable axially-extending rail member 74, which has an axially extending edge portion 74*a* in its illustrated position slidably engaging into a notch 72*b* of each of the disks 72. Thus, the disks 72 are prevented from turning with shaft 68, but may threadably move axially along this shaft as the shaft rotates. As the disks 72 move axially, they slide along the rail 74 with the edge 74*a* in one of the notches 72*b*. Accordingly, it is seen that position of the disks 72 along the shaft 68 is an analog of the position of the gate 12 between its fully opened and fully closed positions.

The rail member 74 is spring loaded in a conventional way to allow its manual movement away from the shaft 68 to disengage edge 74*a* from the notches 72*b*. In this way, each of the disks 72 may be manually rotated independently of shaft 68 to thread these disks 72 (or each one separately) along the shaft to adjust the relationship of these disks axially along the length of shaft 68 to model the position of the gate 12 between its fully opened and fully closed positions.

Opposite to the rail member 74, the gate movement measurement unit 64 includes an axially extending mounting plate 76 providing a plurality of axially spaced apart mounting holes 76*a*, to which limit switches 78 may be attached by respective fasteners 80 (i.e., screws, and only the heads of which are fully visible in FIG. 4) each passing through a portion of the housing of each of the switches 78 and threadably engaging into respective holes 76*a* of the plate 76. The limit switches 78 are arranged as a spaced apart pair.

In rough approximation, the axial spacing between the pair of limit switches 78 is an analog of the distance the gate 12 moves between its fully opened and fully closed positions. Similarly, the axial spacing of the pair of disks 72 along shaft 68 is an analog of the length of the gate frame 18 being moved by the operator 10. These variables will change with each particular installation of a gate operator. The disks 72 move axially as a pair between the switches 78 from adjacent one to adjacent the other as the gate 12 moves between its fully opened and fully closed positions. During operation of the gate operator 10, as the disks 72 threadably move along the shaft 68 in response to rotation of this shaft by operation of the operator 10 moving the gate 12, one of the disks 72 moves so as to contact one switch 78. In each direction of operation, the one disk 72 closest to a switch 78 is the one that actuates that switch.

Figure 5:
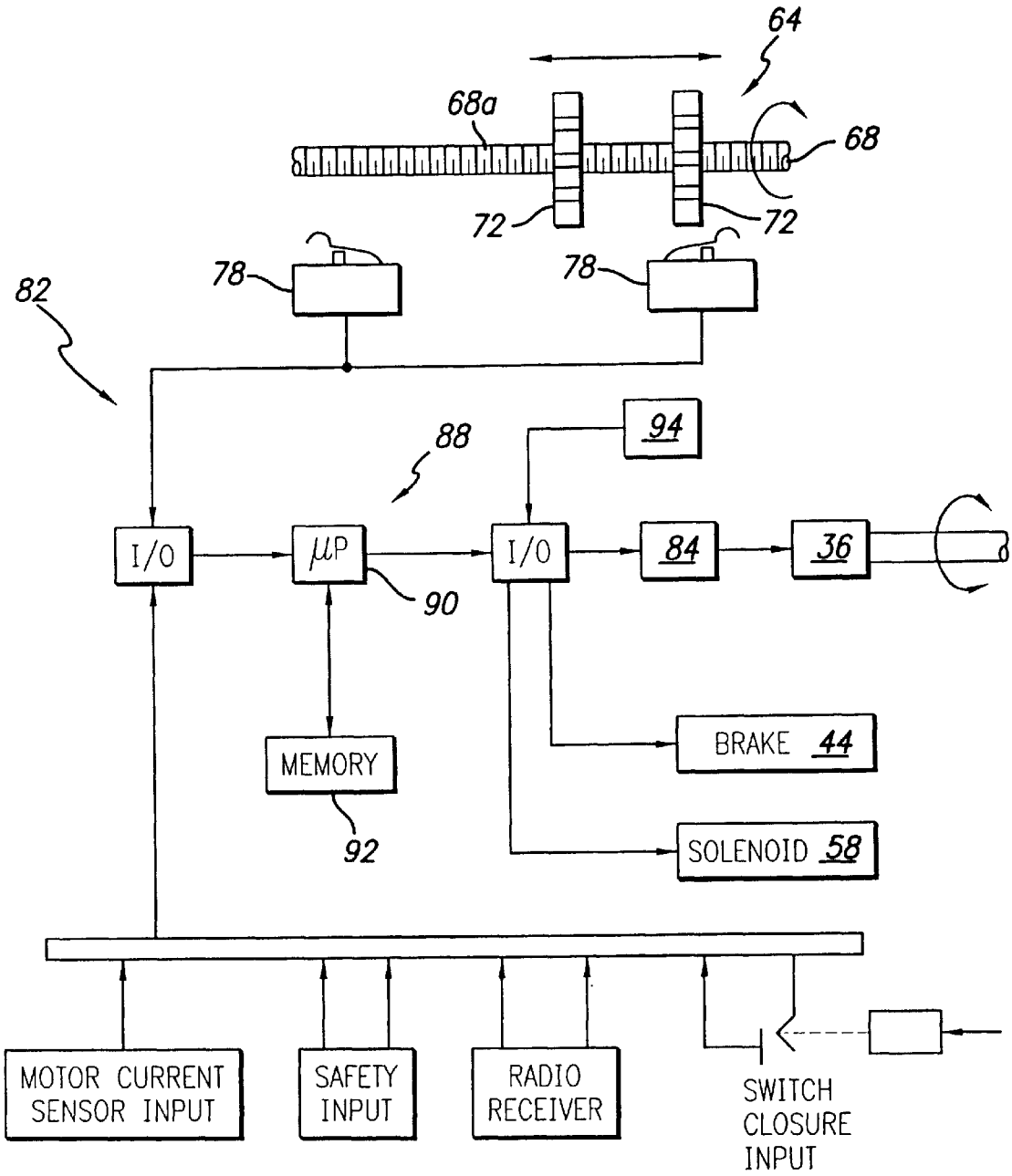

Attention now to FIG. 5 will show that the switches 78 are part of a control circuit 82, the rest of which is housed in electronics unit 66. Preferably, the form of this circuit 82 is a combination of discreet elements carried on one or more printed circuit boards; and also includes one or more integrated circuits (as will be described), although the invention is not limited to this configuration of control circuit. Viewing FIG. 5, it is seen that the control circuit 82 includes a motor control section 84, which is conventional. This motor control section 84 receives input line power, and provides for reversible operation of the motor 36. This reversible operation of the motor 36 provides for both opening and closing movements of the gate 12, as will be familiar to those ordinarily skilled in the pertinent arts. An open/close input may be provided by a momentary contact switch closure, or alternatively, a conventional radio remote control may provide this input command. Alternatively, the motor control circuit section 84 may be configured for separate "open", "close", and "park" inputs.

In each case, the open/close input causes the motor controller 84 to operate the motor 36 in the direction of operation required to effect either an opening or closing movement of the gate 12. An additional safety input 86 from, for example, an optical obstruction sensor (i.e., a sensor using a visible light or invisible infrared light source to provide a light beam, and a receiver providing an output signal should the beam be obstructed by an object) or from an "edge contact sensor", or from a "loop detector", for example, may be used to provide an input to the control unit 82, as will be further described below. Alternatively, the motor control 84 may also have a current-sensing type of obstruction sensing capability in addition to or instead of use of the obstruction sensor input.

Circuit 82 also includes a control portion, which in this case is implemented by use of a microprocessor-based control, generally indicated with the numeral 88. This microprocessor-based control portion 88 includes a microprocessor 90 with associated memory 92, and input/output (i.e., I/O) devices 94 and 96. I/O device 94 provides for contact closure inputs (i.e., CCI's) to the microprocessor 90 from each of the limit switches 78. It will be appreciated that the control portion of the gate operator need not employ a microprocessor based control. That is, a relay logic arrangement, a PLD (programmable logic device) or an ASIC (application-specific integrated circuit) may be used to implement the control logic for the operation of the gate operator 10. Thus, it is seen that the microprocessor-based control of the present embodiment of the invention is not limiting of the invention, but is one of several recognized alternative ways of realizing a control logic and control function for the gate operator 10.

Figure 6:
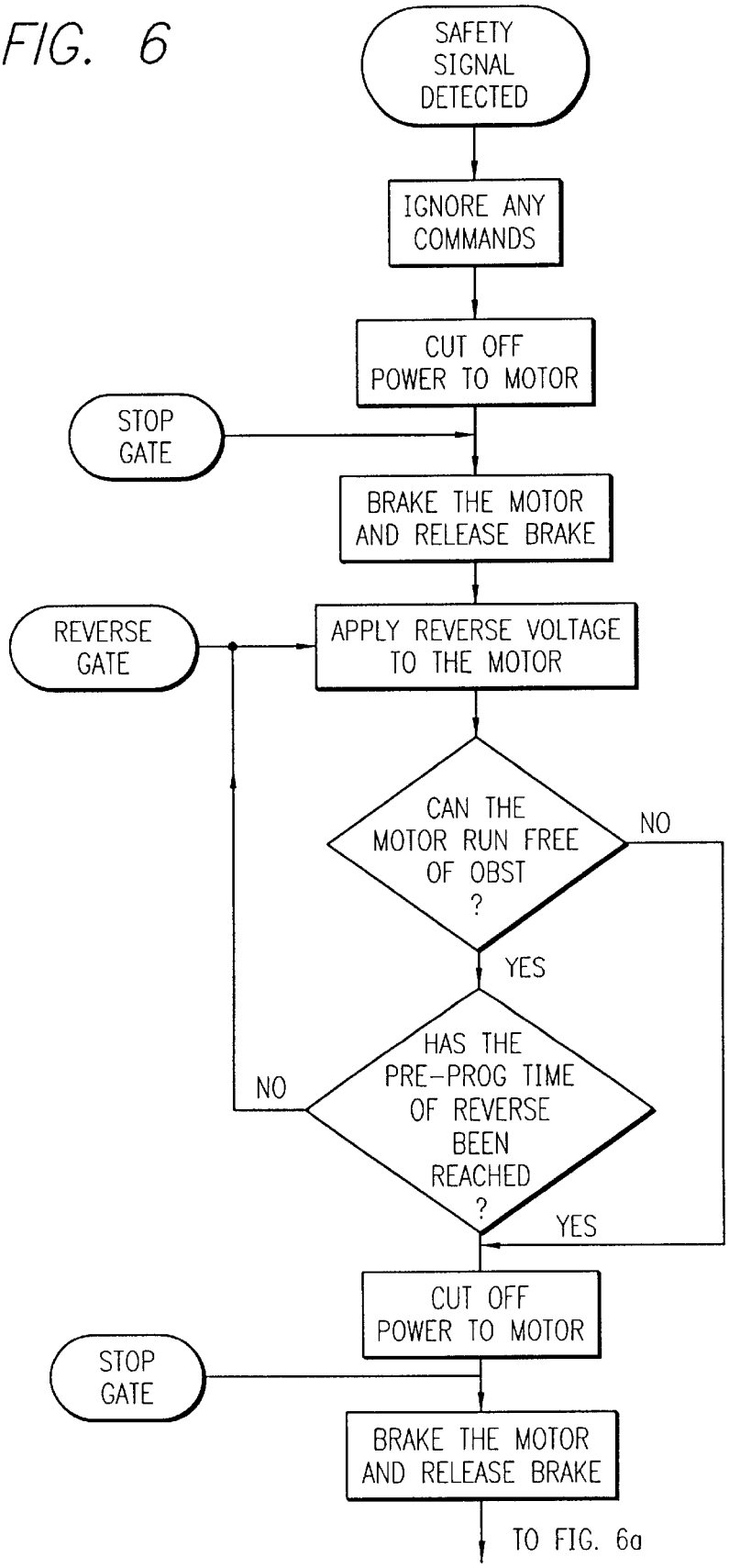
Figure 6A:
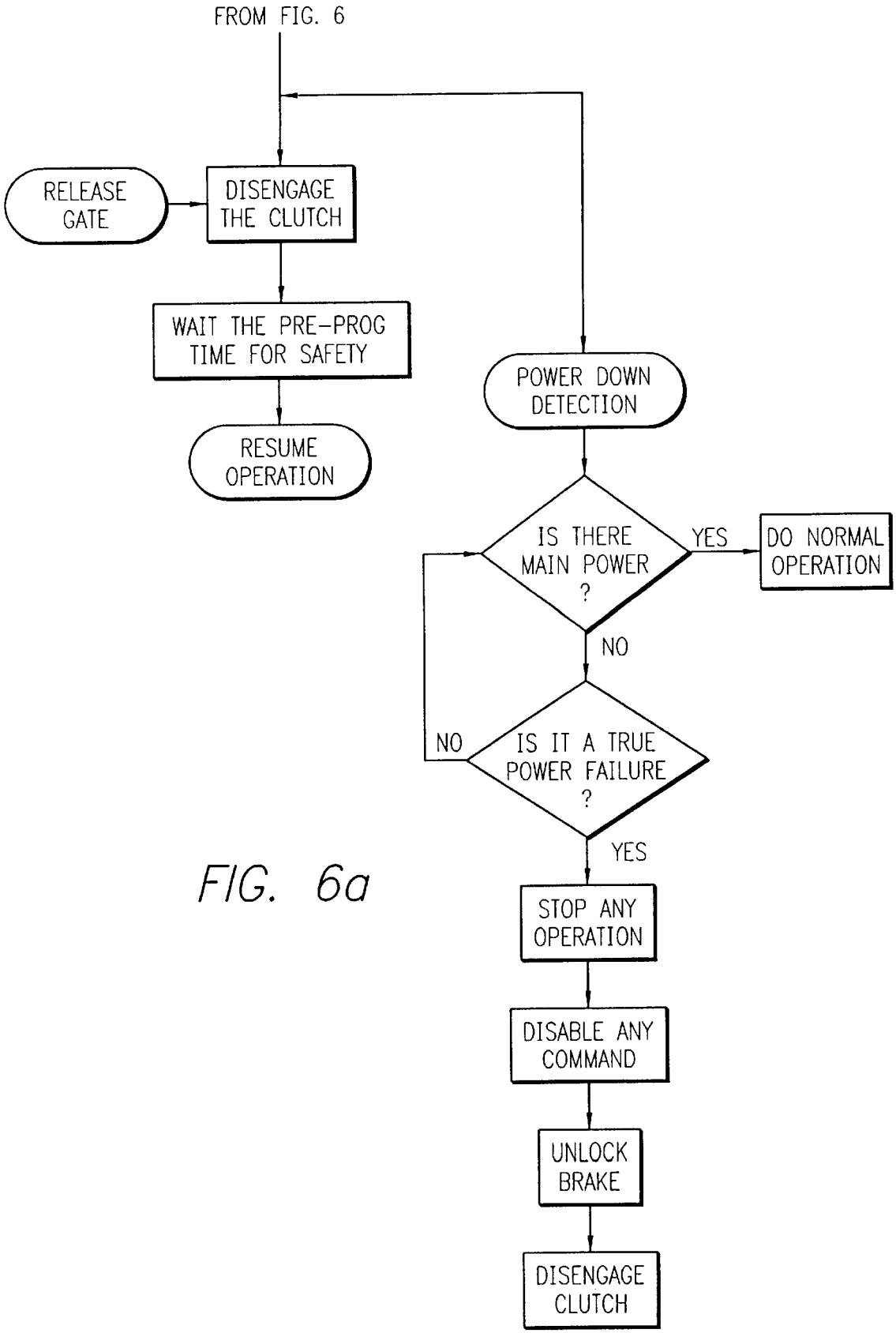
Figure 7:
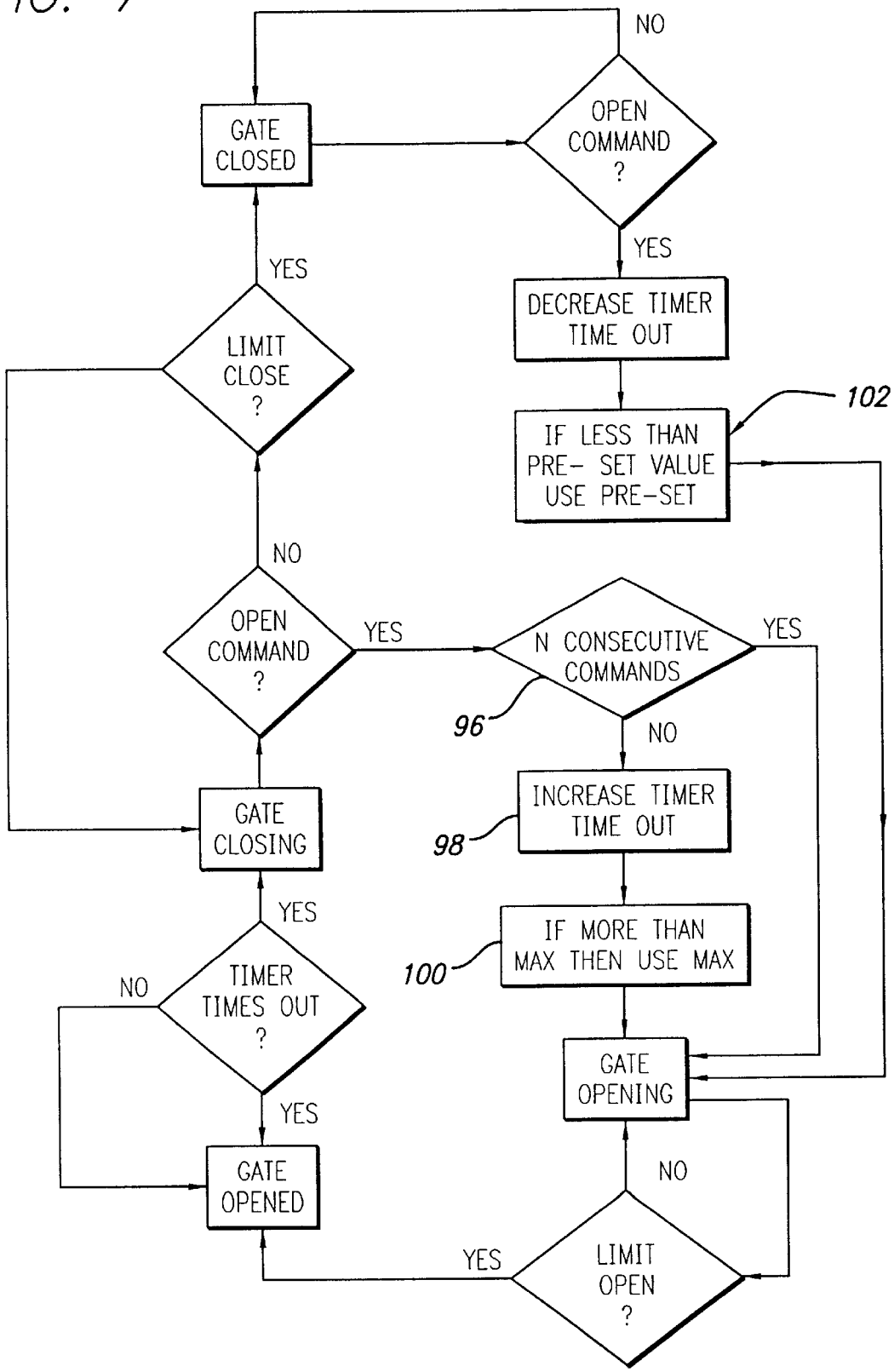

Having observed the structure of the gate operator 10, attention may now be directed to its operation, with attention also to the logic flow charts of FIGS. 6, 6*a*, and 7. As those ordinarily skilled in the pertinent arts will recognized, the flow charts of FIGS. 6, 6*a*, and 7 are used to provide programming commands for the microprocessor 90 to implement the logic set out in these flow charts. Recalling the description above, it will be understood that when the user of the gate 12 desires to open or close this gate, a command input is provided to control circuit 82. This command input may be an "open", "close" or "park" command, for example. In the case of gate operators which have an input from a radio control device, the command input may effect an opening of the gate from its closed position, or may effect a closing of the gate from its opened position. Alternatively, the gate operator may automatically close an opened gate after a time interval of being opened, recalling the description above.

Now, if an obstruction is sensed during either an opening or closing movement of the gate, the operator 10 will stop the gate 12 by shutting off motor 36 and applying brake 44. The gate 12 with thus quickly come to a stop. However, if the obstruction sensed happens to be a person or animal who is entangled in the gate, it is not desirable to reverse the movement of the gate 12 entirely to the opposite limit of its movement, as many conventional gate operators do. As explained above, some conventional gate operators will stop and back a distance away from an obstruction encountered while opening, but will stop and reverse completely to the open position when an obstruction is encountered while closing. Other conventional gate operators stop and reverse to the opposite limit of movement when an obstruction is encountered. Both of these alternatives of the conventional gate operators have disadvantages as discussed above.

In contrast, the gate operator embodying the present invention will implement the logic seen in the flow chart of FIG. 6, and will stop the drive motor 36, apply the brake 44, and then release this brake and reverse the movement of the gate 12, but only for a very brief interval. The distance the gate moves during this brief interval of reversed gate movement will depend upon the particulars of the gate operator installation. As is seen in FIG. 6, the programming allows for a user or installer of the gate operator to program a reversing interval which determines the distance the gate backs up after being braked to a stop. That is, this interval is user-programmable so that the reversing distance can be selected, and with a pre-programmed default time interval for reversed gate movement causing the gate to reverse about six inches or so before it is stopped again.

Preferably, the gate will back up or reverse a distance of about six inches (as mentioned above), and then the motor 36 is again shut off and brake 44 is again applied to stop the gate. This reversal and stop of the gate may free a vehicle, animal, or person who is entrapped in the gate, and should not cause additional injury to the vehicle or living creature. Nest. the gate operator 10, after the stop, reverse, and stop sequence described immediately above, will cause clutch unit 46 to be disengaged by operation of solenoid 58. This disengagement of clutch unit 46 will allow the gate 12 to be manually moved by the application of forces within the abilities of most adults, of larger children, and some animals. Consequently, a child, for example, who has become entangled in the gate may be able to move the gate manually to free themselves. Further, an animal, for example, who may not be able to free itself from an entanglement in the gate, can be freed by a bystander, who will be able to move the gate manually.

Further, the flow chart of FIGS. 6 and 6*a* shows also a test loop determining whether line power is available to the gate operator 10. In the event that line power becomes unavailable (i.e., because of a power failure, for example), the control circuit 82 will utilize power from back-up battery 94 to energize solenoid 58, disengaging clutch 46. Thus, in the event of a power outage, the gate 12 may be manually opened to allow ingress and egress via the gate opening 14. This feature of a power-off release of the gate is user-selectable, and can be selected or disabled dependent upon the local requirements, and the user's preferences. For example, the user of the gate 10 may have concerns for maintenance of the security provided by gated access during a power outage, versus the possible need of officials (fire and medical, for example) to gain access to a gated facility during such a power outage.

Figure 5A:
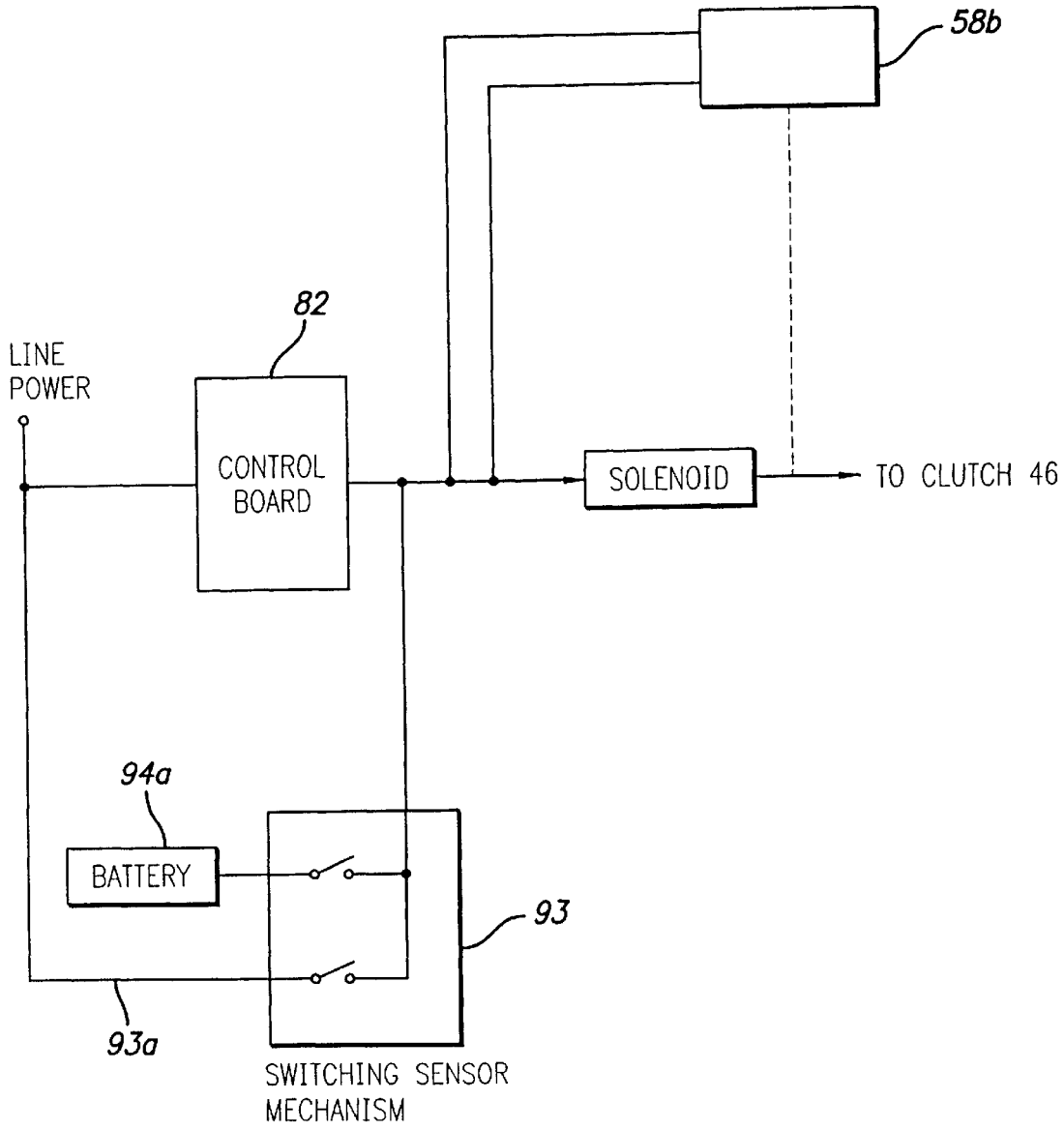

FIG. 5*a* shows in fragmentary part, an alternative embodiment of the control system 82, and is again shown at the level of the schematic of FIG. 5. In order to obtain reference numerals for use in describing this alternative embodiment of the invention, the same numerals used above are employed with a suffix alphabetical character added. Viewing FIG. 5*a*, it is seen that a modification is presented of the battery-powered gate-release aspect for the gate operator 10.

According to the schematic shown in FIG. 5*a*, a line-power-responsive contactor 93 is provided. The function of this line-power-responsive contactor 93 in the event that a line power failure is sensed on line-power connection 93*a*, is to close automatically and when closed to provide power from battery 94*a* to solenoid 58*a*. Again, the solenoid 94*a* drives the clutch 46 to a disengaged position. In this case, in order to protect the solenoid 58*a*, a set of contacts are provided in a switch 58*b* which are associated with the solenoid 58*a* (i.e., are series connected with this solenoid), and which are opened when the solenoid drives the clutch 46 to the disengaged position. This opening of the contacts 58*b* opens also the circuit from battery 94*a* to the solenoid 58*a* so that battery power does not continue to flow through this solenoid once it has done its job of opening the clutch 46. A bypass circuit (not shown) may be provided to allow authorized reclosing of the clutch 46 using solenoid 58*a*, or a manual reclosing of the clutch 46 may be effected to put the gate operator back into service after the clutch 46 is opened as described above.

Further to the above, it will be noted that as the gate 12 is opened or closed, either by the operator 10 or by manual force, and with clutch 46 engaged or disengaged, the shaft 68 is always rotated proportionately to the movements of the gate, and the isks 72 thread along this rotating shaft also in proportion to the movements of the gate 12. Consequently, after a disengagement of clutch 46, the gate operator 10 can be put back into service by a user command input to control circuit 82, which effects an opposite driving of solenoid 58, and an engagement of clutch 46. The clutch 46 may be engaged in any relative rotational position on shaft 38, because the limit positions for the gate 12 have been retained in measurement unit 64. That is, no resetting or readjustment of limit positions is required after a disengagement and re-engagement of clutch 46.

Considering now FIG. 7, a logic flow chart diagram is presented of additional programming for the microprocessor 90 of the control circuit 82. In this case, the programming depicted is effective to eliminate the situation described above of the gate 12 dithering between fully opened and closing movements during periods of continual traffic flow via the gate opening 14, which substantially matches in frequency the pause interval of the fully-opened-pause timer of the gate operator 10. It will be understood that the control circuit 82 implements a pause timer (i.e., the fully-open-pause timer) by operation of microprocessor 90, which causes the gate 12 to be paused at its fully-opened position. This pause allows a vehicle to pass through the gate opening, but discourages unauthorized entry by starting the gate closed promptly. On the other hand, if the gate operator detects a situation of frequent gate opening requests (i.e., "n" consecutive open commands in time period "X"), while the gate is either fully open and in a reset condition because of high traffic flow or is paused (i.e., while the fully-opened-pause timer is counting down), or while the gate is in its closing movement after being fully opened (as is indicated at decisional branch 96), then the fully-opened-pause timer for pausing the gate at its fully opened position is incremented upward by a value of "Y" seconds (indicated at 98).

This testing and successive incrementing upwardly of the fully-opened-pause timer will continue so long as the period of traffic flow which is continual with a frequency close to or higher to that set by the pause timer continues, or until a maximum value for the incrementing of the fully-opened-pause timer (indicated at 98) is reached. In this condition of the control circuit 82, the gate 12 will be pausing sufficiently long after each "open" request from traffic approaching the gate that it will more than likely not be starting closed in the interval between passage of vehicles through the gate opening.

Once the time of continual (i.e., frequent) traffic through the gate passes, and the fully-opened-pause timer times out, if the gate achieves its fully closed position before another request for it to open is received, then the fully-opened-pause timer is reset to its pre-set value (indicated at 102).

In view of the above, it is seen that the present invention provides a gate operator with important safety features implementing a stop-reverse-stop-release sequence of operations for the gate when an obstacle is encountered or sensed during movement of the gate. Thus, manual movement of the gate is facilitated in order to allow an obstruction to be cleared from the path of the gate, for example. Further, the invention provides a gate operator which responds dynamically to the traffic flow conditions existing for the gate, so that dithering of the gate near its fully opened position is eliminated or reduced during times of continuous traffic flow having a frequency generally matching the interval of a fully-opened-pause timer for the gate.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A safety gate operator for moving a gate between opened and closed positions, said gate operator comprising:

a base member an electric motor and motor controller circuit;

a speed reduction power train carried on said base member and coupling said electric motor to said gate to move the gate between opened and closed positions;

a gate position sensor providing a signal indicative of gate position;

a safety means during operation of said electric motor sensing at least one event selected from the group consisting of:

approach of a vehicle to the gate opening, contact of the gate with an object or with a person, and movement of an object or person into the gate opening, said safety means responsively providing a safety signal;

a brake effective when applied to stop movement of said gate;

said speed reduction power train including a clutch coupling power from said electric motor to said gate, and when disconnected allowing movement of said gate without back driving of said electric motor while still providing responsive movement of said gate movement sensor;

a control system including a memory facility; and said control system including logic for in response to said safety signal sequentially:

stopping operation of said electric motor, applying said brake to stop movement of said gate;

then operating said electric motor in a reverse direction only momentarily to move the gate in a reverse direction, and then again stopping operation of said electric motor and again applying said brake to stop the gate for a second time;

the gate operator further including a clutch/brake assembly including both said brake and said clutch;

wherein said speed reduction power train includes an output shaft, said clutch/brake assembly including an electromagnetic brake unit having an electromagnetic anchor member secured for torque reaction to said base member, and said electromagnetic brake unit also having an armature carried on said output shaft.

2. The gate operator of claim 1 wherein said armature member is freely rotatable relative to said output shaft.

3. The gate operator of claim 2 wherein said clutch/brake assembly also includes a clutch unit having a driving member drivingly connecting to said output shaft, and a driven member turning freely relatively to said output shaft, said power train including means for drivingly connecting said driven member to said gate to move the latter between opened and closed positions in response to rotation of said driven member, said driven member and said driving member being relatively movable between an engaged first relative position in which said driven and said driving members rotate in unison with said output shaft, and a disengaged second relative position in which said driven member is free to rotate relative to said output shaft.

4. The gate operator of claim 3 in which said armature is drivingly connected to said driven member to rotate in unison therewith, whereby application of said electromagnetic brake brakes said driven member irrespective of engagement or disengagement of said clutch unit.

5. The gate operator of claim 3 in which said clutch unit is of dog-clutch type, said driven member and said driving member each having respective dogs interdigatating in said first relative position of said members to drivingly connect the latter for rotation in unison.

6. The gate operator of claim 5 in which said clutch unit further includes a clutch sleeve member drivingly carried on said output shaft, a mechanical bi-stable device moving said clutch sleeve member between first and second locations in which said driving and driven members are in said first and second relative positions respectively, and a solenoid effective when energized to move the bi-stable device between said first and second locations.

7. The gate operator of claim 3 in which said clutch/brake assembly includes a sprocket unit including two sprockets in axially spaced and drivingly connected relation to one another.

8. The gate operator of claim 7 in which said power train further includes a drive chain drivingly connecting to one of said two sprockets and to said gate.

9. The gate operator of claim 7 in which said gate position sensor includes a ratable shaft rotation of which is indicative of gate position and which produces said signal indicative of gate position, another drive chain drivingly engaging the other of said two sprockets and also engaging a second sprocket carried drivingly by said ratable shaft of said gate position sensor, whereby said ratable shaft of said gate position sensor is rotated whenever said gate moves between said opened and said closed positions irrespective of whether said clutch unit of said clutch/brake assembly is engaged or disengaged.

10. A gate operator for selectively moving a gate member between opened and closed positions relative to a gate opening, said gate operator moving the gate to an opened position in response to a gate-open commend, and further including a fully-opened-pause timer for implementing a determined pause interval during which the gate is stationary at its fully opened position, after which the gate operator automatically moves the gate member to its closed position; said gate operator further including:

control means having logic for:

determining the number of gate-open commands received by the gate operator in a certain time interval, and comparing this number of gate-open commands to a pre-determined number; and if the number of gate-open commands exceeds the pre-determined number, for incrementing the fully-opened-pause timer upwardly by a pre-determined time amount.

11. The gate operator according to claim 10 wherein said control means logic further includes iterative logic for:

determining the number of gate-open commands received by the gate operator in a certain time interval, and comparing this number of gate-open commands to the pre-determined number; and if the number of gate-open commands exceeds the pre-determined number further and successively incrementing the fully-opened-pause timer upwardly by said pre-determined time amounts until the fully-opened-pause timer has a pause interval equal to a pre-set maximum pause interval.

12. The gate operator according to claim 10 wherein said control means logic further includes logic for decrementing the pause interval of said fully-opened-pause timer to the determined pause interval upon said timer timing out, and said gate operator moving the gate from its fully opened position to its fully closed position.

* * * * *